US005673677A

United States Patent [19]

Wing

[11] Patent Number: 5,673,677

[45] Date of Patent: Oct. 7, 1997

[54] PROJECTILE LAUNCHING APPARATUS AND METHOD

[76] Inventor: Stanley D. Wing, 2477 Highway 20, Sedro Woolley, Wash. 98284

[21] Appl. No.: 706,272

[22] Filed: Sep. 4, 1996

[51] Int. Cl.[6] ..... F41B 3/02

[52] U.S. Cl. ..... 124/20.3; 124/17; 124/20.1

[58] Field of Search ..... 124/16, 17, 20.1, 124/20.3, 22, 23.1, 25.6

[56] References Cited

U.S. PATENT DOCUMENTS

| | | | |
|---|---|---|---|
| 1,072,988 | 8/1913 | Pratt et al. | 124/16 |
| 1,153,415 | 9/1915 | Beaty | 124/1 |
| 2,430,685 | 11/1947 | Pearson | 124/16 |
| 3,509,863 | 5/1970 | Barker | 124/16 |
| 3,595,213 | 7/1971 | Storer | 124/17 |
| 3,874,359 | 4/1975 | Cesin | 124/16 |
| 4,169,453 | 10/1979 | Hunsicker | 124/20.1 |
| 4,338,909 | 7/1982 | Plummer | 124/16 |
| 4,458,657 | 7/1984 | Stockmar | 124/17 |
| 4,651,707 | 3/1987 | Bozek | 124/17 |
| 4,662,344 | 5/1987 | Mitchell | 124/22 |
| 4,911,136 | 3/1990 | Brown | 124/20.1 |
| 5,072,715 | 12/1991 | Barr | 124/20.1 |
| 5,503,135 | 4/1996 | Bunk | 124/16 |

*Primary Examiner*—John A. Ricci
*Attorney, Agent, or Firm*—Robert B. Hughes

[57] ABSTRACT

A launching apparatus comprising an "H"-shaped frame, having right and left frame sections, with swing arms pivotally mounted at forward ends of the frame section. Each swing arm has a forward portion which interconnects with a cable and pulley system, and a rear portion which connects to an elastic tension member extending from the rear portion of the swing arm to a rear location on the "H" frame. A middle draw portion of the cable extends between front pulleys on the forward ends of the swing arms, and when the middle portion of the cable is pulled rearwardly, the swing arms rotate so that the front pulleys move inwardly and rearwardly, and then further rearwardly and outwardly. At the same time, the elastic tension members become stretched.

16 Claims, 12 Drawing Sheets

PROJECTILE LAUNCHING APPARATUS AND METHOD

BACKGROUND OF THE INVENTION

1. Field of the Invention

The present invention relates to a projectile launching apparatus and method, and more particularly such a launcher which is hand held and can project a pellet, BB, arrow, dart or other object.

2. Background Art

There have been for many centuries various hand held devices to propel an object, used for hunting, warfare, sport or amusement, such as the bow and arrow, slingshot, or crossbow. The common theme or principle in these devices is that there is a drawstring portion or pocket which is moved from a rest position back to the launching position (or full draw position). As this is done energy is stored in a spring-like or elastic member, so that upon release, this is transmitted to the drawstring portion or pocket to launch the projectile. In a basic bow or slingshot, as the drawstring portion or pocket is pulled further rearwardly, the resisting force increases relative to the distance the drawstring portion or pocket is retracted, and is at a maximum where when the drawstring or bow is at the launching position.

Over the years there have been various efforts to create different devices that operate on these same general principles, but provide some particular benefit or advantage. Some of these are directed toward improving the "mechanical advantage" provided to the user. Others are directed toward making the resisting force more uniform along the path of travel of the drawstring or pocket, or possibly modifying the resisting force at certain locations to obtain some benefit. For example, some of these devices are made so that toward the latter part of the pull stroke the resisting force becomes less so that the person feels a lower level of force when the pocket or drawstring is in the full launch position. There have been other considerations, such as durability, simplicity of design and/or operation, cost of manufacture, ease and convenience of handling, etc.

It is an object of the present invention to provide a projectile launching apparatus and method which provides a desirable balance of features, namely having the capability of launching the projectile at a substantial speed, reliability, simplicity, ease of operation, and other qualities.

SUMMARY OF THE INVENTION

The projectile launching apparatus of the present invention comprises a base frame having a longitudinal center axis, a transverse axis, a front end and rear end. The base frame has a support portion, and right and left frame sections, each of which has a front pivot location, a cable positioning location, and a rear tension load bearing location.

There are right and left swing arms, each having a first front end portion at which there are right and left pulley means, respectively, at front pulley locations. The swing arms have a second end portion at which there is a front tension load bearing location, and an intermediate portion having a pivot location. The right and left swing arms are pivotally mounted at their respective pivot locations to the right and left frame sections, respectively, at the front pivot locations of the frame sections.

The right and left swing arms are mounted and arranged for rotation between a first rest position where the right and left front pulley means at the front end portion are at a more forward location, and a second launching position where the right and left front pulley means are at a more rear location.

There are right and left tension members, each being connected at a rear end thereof to a respective rear tension leading bearing location of the right and left frame sections, and connected at a front end thereof to the second end portion of the right and left swing arms, respectively, at respective front tension load bearing locations.

There is a cable means having a middle cable portion extending between said front pulley means of the swing arms and being in operative engagement with the front pulley means. Also, there are right and left cable portions extending operatively from the right and left front Pulley means to connect operatively to the right and left frame sections, respectively, at the cable positioning locations of the right and left frame means.

The apparatus is arranged in a manner that when the middle cable portion is pulled rearwardly, the right and left front pulley means are pulled rearwardly to cause the second end portions of the right and left swing arms to move forwardly and thus extend the right and left tension members.

In the preferred form, the launching apparatus comprises right and left rear pulley means mounted, respectively, at the cable positioning locations of the right and left frame sections. The right and left cable portions each have first cable sections extending from the front pulley means of the right and left arm members to operatively engage the right and left rear pulley means and second cable sections of the right and left cable portions extend back to the front end portions of the right and left swing arms to have operatively connections at locations of the front end portions of the right and left swing arms.

More particularly, each of the front pulley means of the right and left swing arms comprises at least first and second front pulley members, and the second cable sections of the right and left cable portions that extend from the rear pulley means to the front pulley means engage said second pulley of its related front pulley means and extends rearwardly therefrom to form third rearwardly extending cable sections of the right and left cable portions. The middle cable portion engages the first pulley members of the right and left front pulley means.

In one embodiment, each of the third rearwardly extending cable sections of the right and left cable portions connect to, respectively, the right and left frame sections.

In another embodiment, each of the rear pulley means comprises first and second rear pulley members. The first and second cable sections of each of said right and left cable portions engage, respectively, first rear pulley members of the right and left cable portions. The third cable section of each of said right and left cable portions extends around its related pulley member of the rear pulley means to extend forwardly as a fourth pulley section to connect to the front end portions of the right and left swing arms.

In the preferred form, the right and left swing arms are arranged in the apparatus relative to the cable means so that the front end portions of the swing arms and moving from the first rest position rotate toward the longitudinal center axis to an intermediate swing arm position, and continue rotation toward said second launching location so as to move away from said longitudinal axis. At the same time, the second end portions of the right and left swing arms move from the rest position in a direction away from said longitudinal axis toward an intermediate position, and move from the intermediate position toward the launching position in a manner to move toward the longitudinal center axis.

In a preferred form, a distance from the pivot mounting location of the right and left swing arms to the tension load bearing location is between about one to two times as great as a distance from the pivot mounting location to the front pulley location.

Also, in the preferred form, in the rest position the front tension load bearing locations on the right and left swing arms are positioned further away from the longitudinal axis than a line drawn between the front pivot location and the rear tension load bearing location of the right and left frame sections. Also, in the rest position, a line drawn between the front pivot location of the right and left swing arms to the frame extends between the front pivot location or the right and left frames, respectively, and the longitudinal center axis. Further, the rear tension load bearing locations of the right and left frame sections, respectively, are positioned between the longitudinal axis and a line drawn from the front pivot location to the rear tension load bearing location of the right and left frame sections, respectively.

Also, the present invention comprises a launching apparatus and projectile combination. This comprises the launching apparatus as described above. Further, it comprises a projectile having a cable engaging portion which defines a rearwardly facing and rearwardly open recess to receive the middle cable portion. There is also a projectile engaging portion positioned rearwardly of the recess. The projectile engaging portion is adapted to be engaged to pull the projectile in a rearward direction to pull the middle cable portion rearwardly.

In one configuration, in this combination the projectile is a dart, having front point member, and rearwardly extending legs defining the recess.

In another form of the combination, the projectile is an arrow with an arrow shaft, and the recess forming portion is connected to a rear end portion of the shaft. Also, the engaging portion of the projectile in the combination comprises a loop means extending in at least a partial loop to engage a releasable pull member.

DESCRIPTION OF THE PREFERRED EMBODIMENTS

Figure 1:
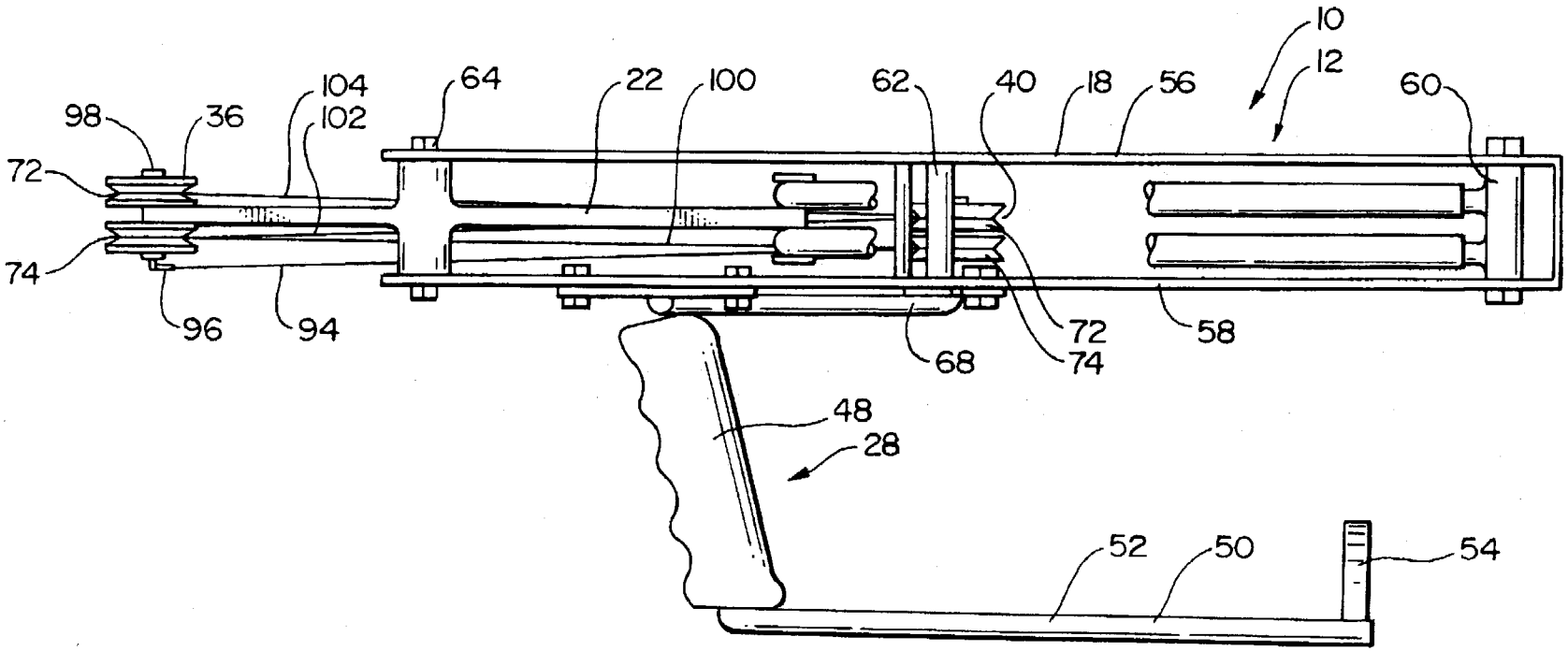
FIG. 1 is a side elevational view of the preferred embodiment of the present invention.

With reference to FIGS. 1 through 4, the projectile launcher 10 of the present invention comprises a main frame 12 which has an "H" shape, to comprise a middle transverse frame section 14, and right and left longitudinally extending frame sections 16 and 18, respectively.

Pivotally mounted to the forward ends of the frame section 16 and 18 are right and left swing arms 20 and 22. Extending from the rear end of the swing arms 20 and 22 are right and left tension members 24 and 26, respectively, provided in the form of sections of rubber tubing. There is a handle grip support section 28 connected to the frame midsection 14, and a cable and pulley system 30. For purposes of description, the apparatus 10 shall be considered as having a longitudinal center axis 31 and a transverse axis 32.

The cable and pulley system 30 comprises a single continuous cable 33, right and left front pulley sets 34 and 36, and right and left rear pulley sets 38 and 40. The cable 33 can be considered as having a central projectile launching portion 42, and right and left cable tensioning portions 44 and 46, respectively.

Figure 2:
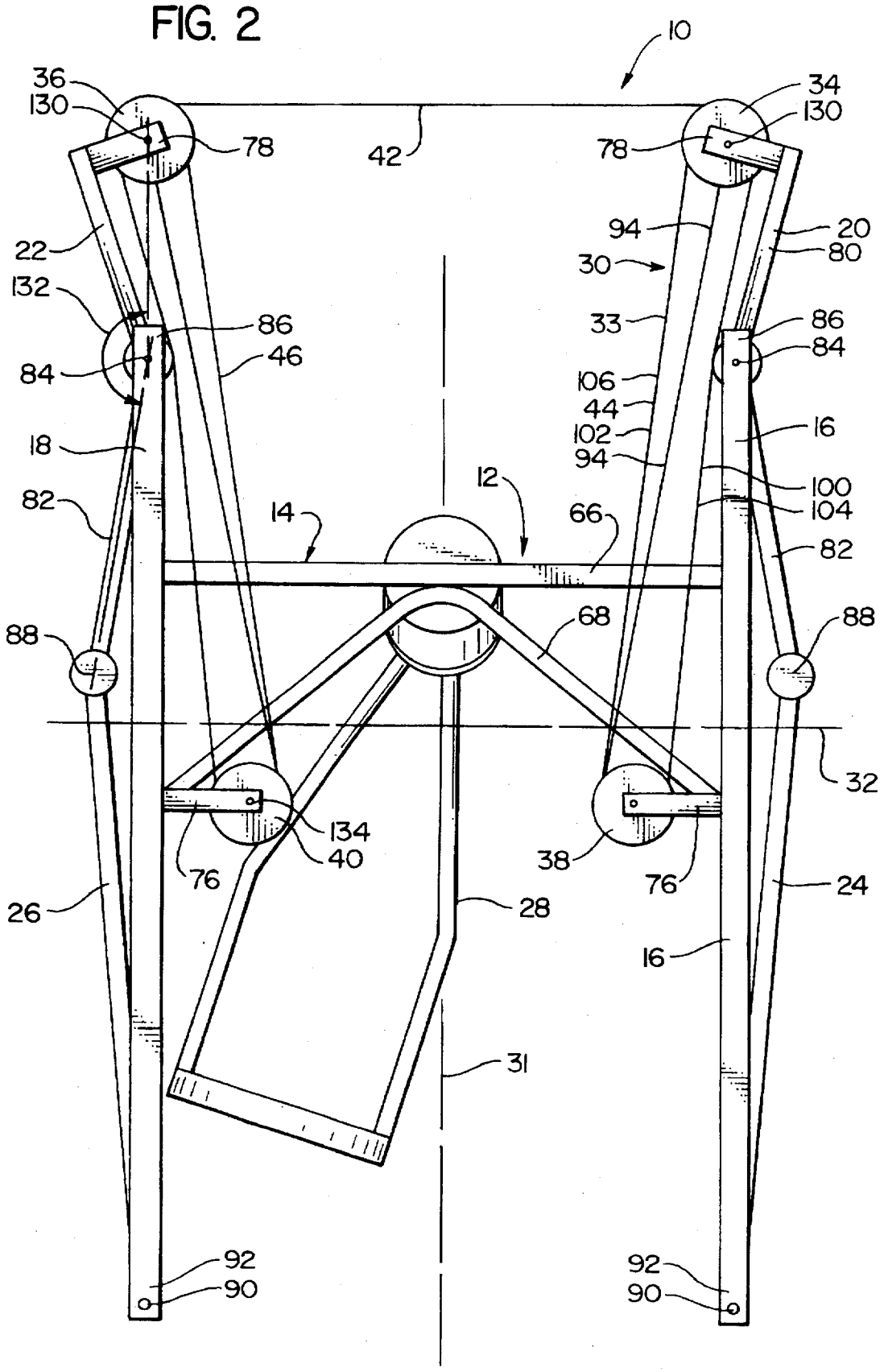
FIG. 2 is a top plan view of this first embodiment, showing the launcher in its initial position.
Figure 3:
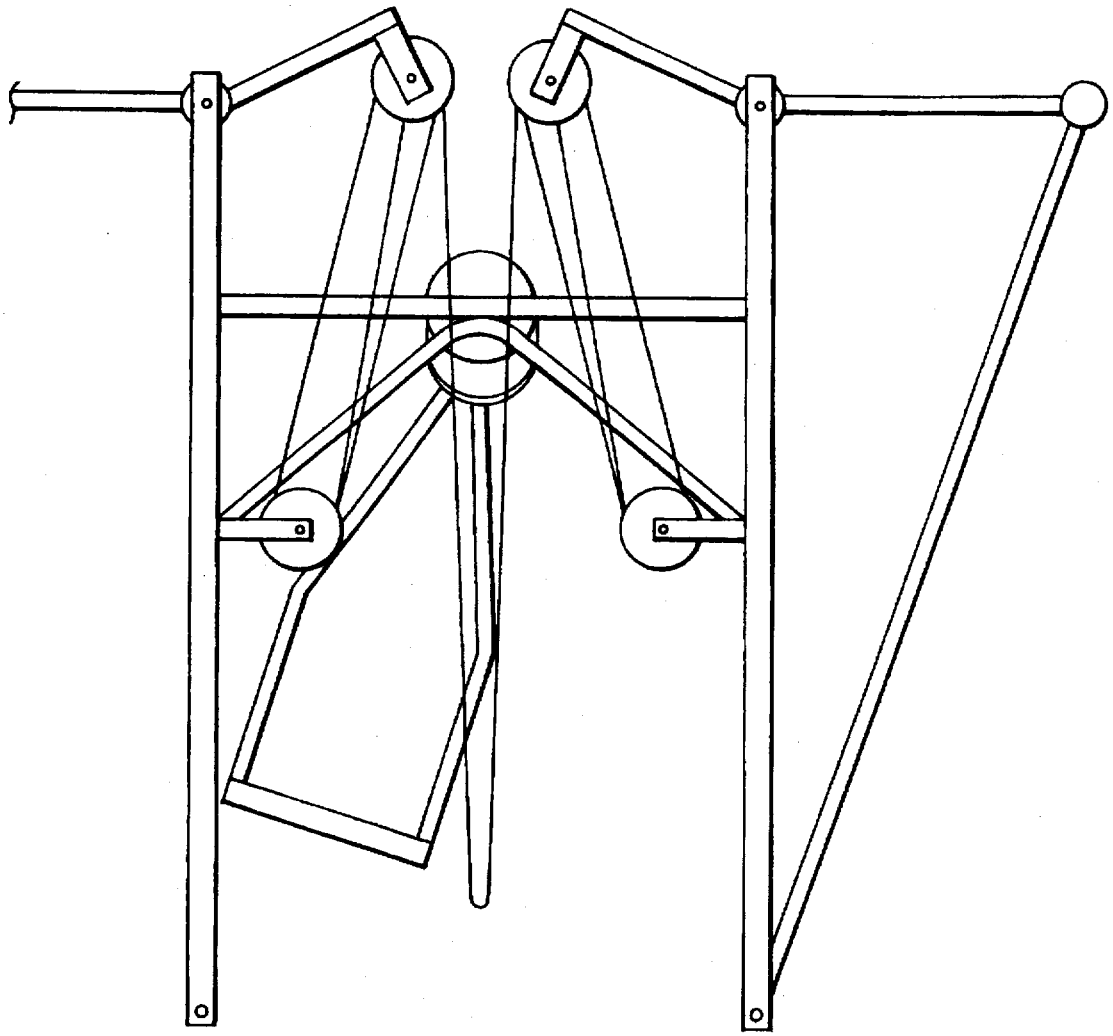
FIG. 3 is a view similar to FIG. 2 showing the launcher in its intermediate position.
Figure 4:
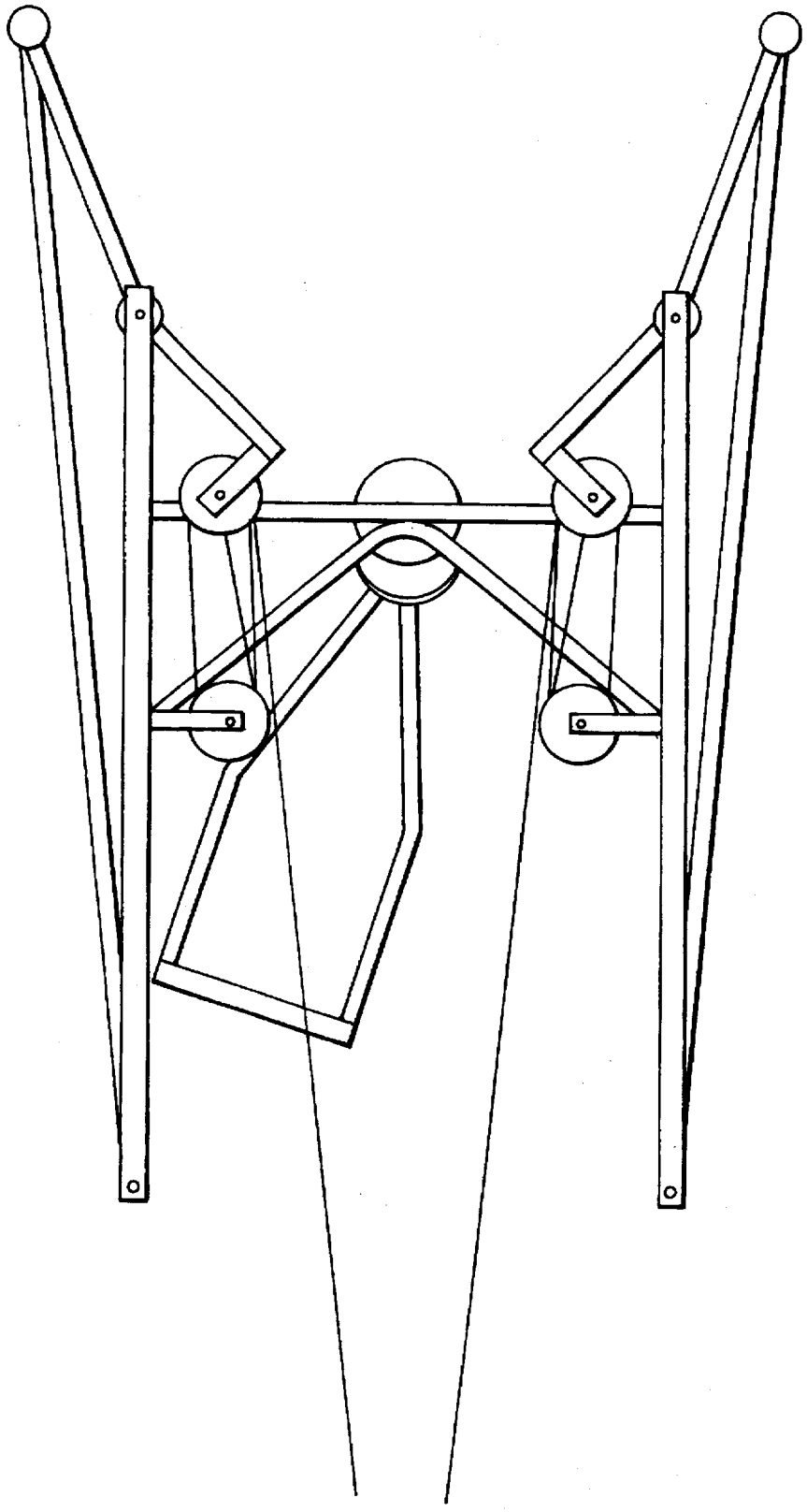
FIG. 4 is a view similar to FIGS. 2 and 3, showing the launcher in its fully retracted position.
Figure 5:
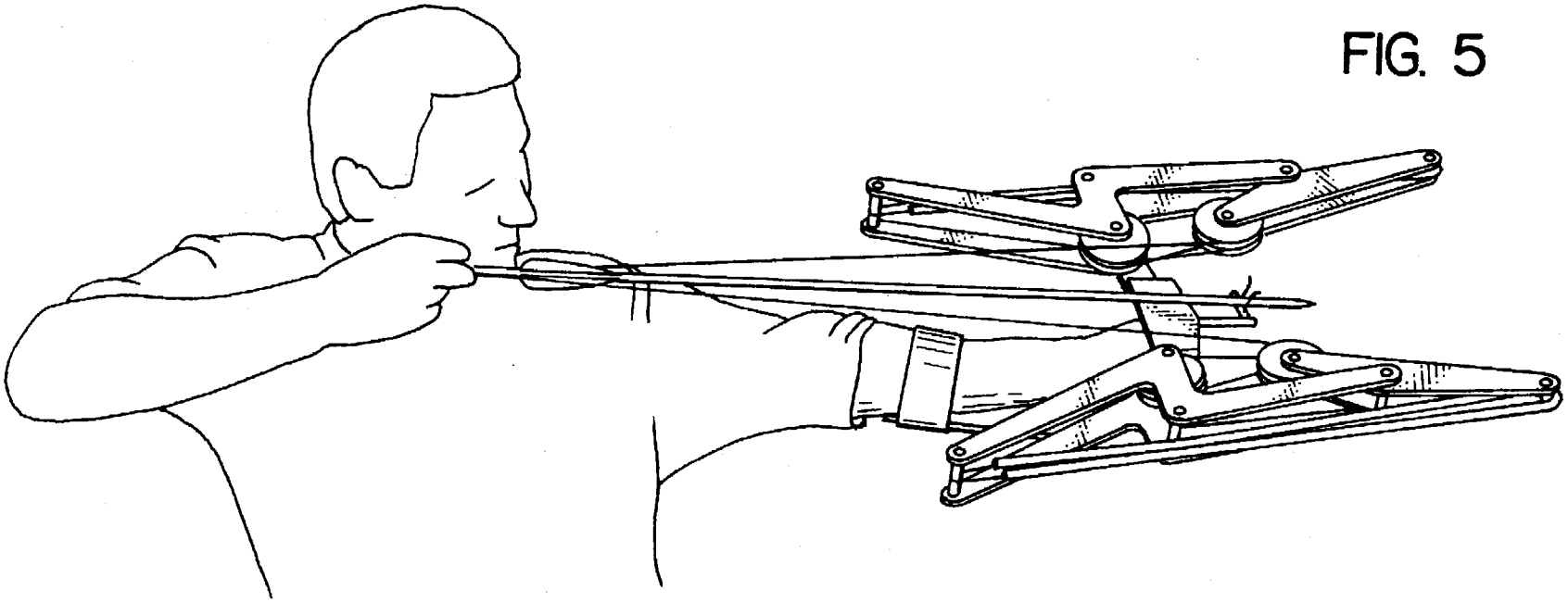
FIG. 5 is an isometric view showing the launcher of this first embodiment in use, and being in its fully retracted position.
Figure 6:
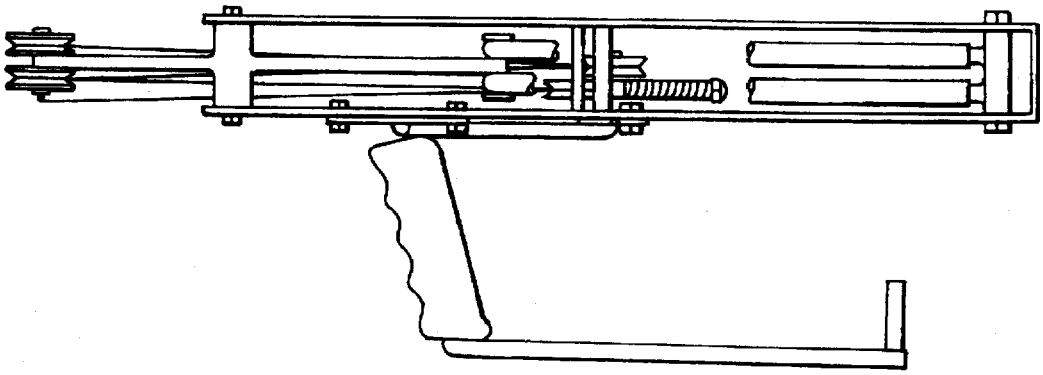
FIG. 6 is a side elevational view of a second embodiment of the present invention.
Figure 7:
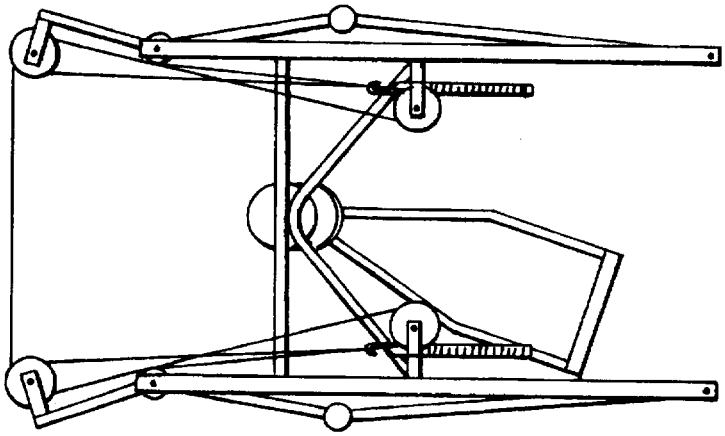
FIG. 7, 8 and 9 are three top plan views of the second embodiment in its initial position (FIG. 7); intermediate position (FIG. 8) and fully retracted position (FIG. 9)
Figure 8:
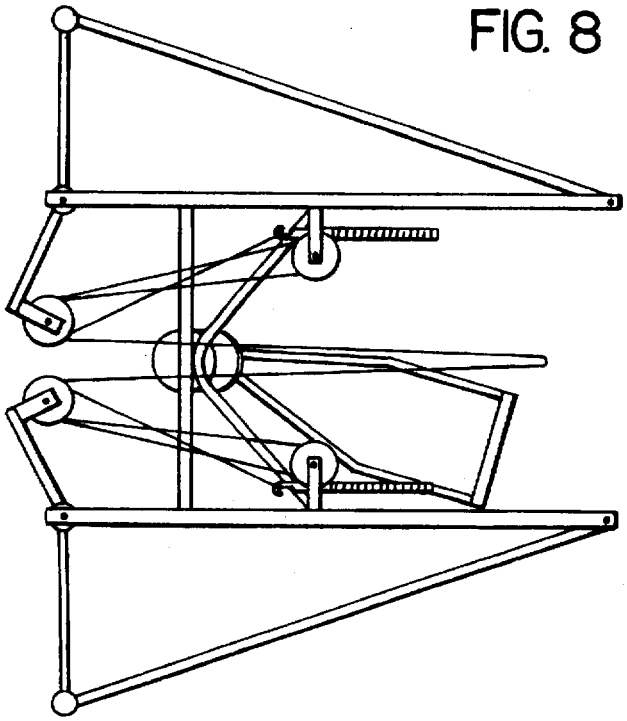
Figure 9:
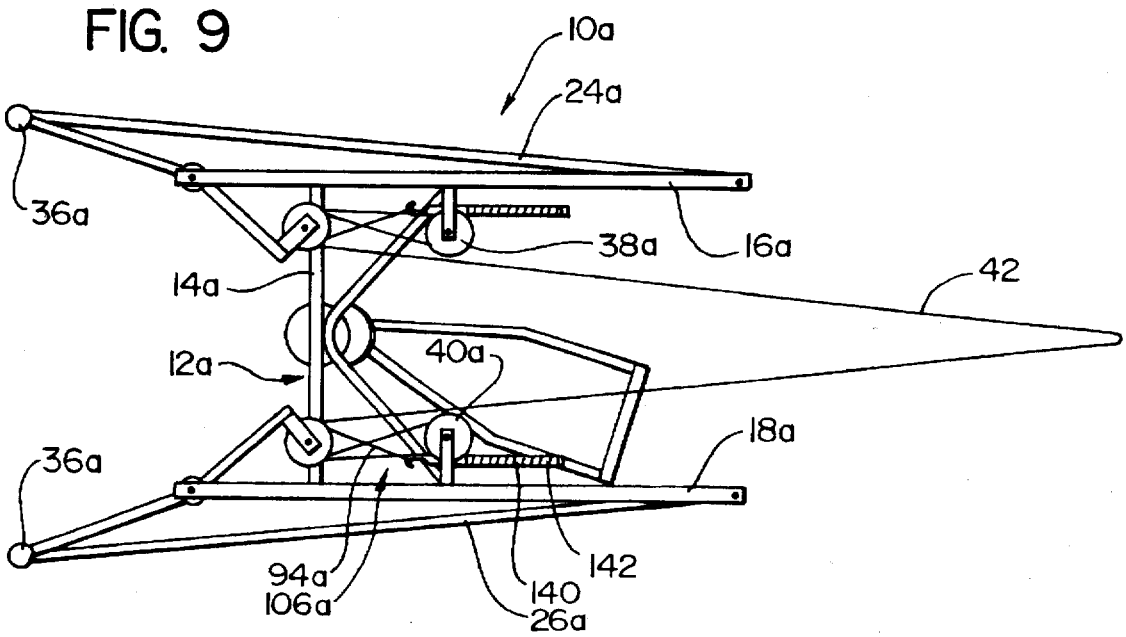

The overall operation of the present invention can readily be understood by viewing FIGS. 2, 3 and 4. In the rest position of FIG. 2, the tension members 24 and 26 are retracted, and the forward pulley sets 34 and 36 are at a full forward position, with the cable tensioning sections 44 and 46 in their fully extended position. As the center cable portion 42 is grasped and moved rearwardly to the mid-draw position of FIG. 3, the swing arms 20 and 22 rotate approximately 75° to 80° to extend the tension members 24 and 26, and to shorten the cable tensioning portions 44 and 46.

In the full draw position in FIG. 4, the tension members 24 and 26 are fully extended, the swing arms 20 and 22 have rotated further, and the cable tensioning portions 44 and 46 have retracted yet further. Upon release of the center draw cable portion 42, the tension members 24 and 26 rapidly rotate the swing arms 20 and 22 to pull the center cable portion 42 very rapidly in a forward direction to launch the projectile.

To proceed to a more detailed description of the present invention, as can be seen in FIG. 1, the handle section 28 comprises a forward vertically aligned hand grip portion 48 and a semi-circular forearm gripping portion 54. Each side frame section 16 comprises upper and lower bars 56 and 58 joined to one another by a rear vertical member 60, an intermediate vertical member 62, and a forward connecting bolt or pin 64. The cross frame member 14 comprises a forward straight bar 66 and a V shaped bracing bar 68, extending between the two lower longitudinal bars 58. Each of the four pulley sets 34 through 40 comprises upper and lower independently rotatable pulleys 72 and 74, respectively. The rear pulley sets 38 and 40 are mounted a short distance inwardly from the side frame sections 16 and 18 by means of suitable mounting brackets 76.

The two front pulley sets 34 are mounted by inwardly extending brackets 78 that extend at right angles from the forward part of the two arms 20 and 22.

Each of the arms 20 and 22 has a forward arm portion 80, and a rear arm portion 82, positioned on opposite sides of the pivot connection 84 by which each of the arms 20 and 22 are mounted to the forward ends 86 of the right and left frame sections 16 and 18. The rear end 88 of each of the rear arm sections 82 is connected to the front end of the related tension member 24 or 26. The rear ends of the tension members 24 and 26 connect at a location 90 at the rear ends 92 of the related lateral frame section 16 and 18.

As indicated previously, the cable and pulley system 30 comprises the cable 33 and the pulley sets 34–40, and the cable 33 has the forward draw section 42 and the side cable sections 44 and 46. Each cable section 44 and 46 has four full length cable portions extending between its related sets of pulleys 34–38 and 36–40. As can be seen in FIG. 1, there is a lowermost cable portion 94 which is anchored at its front end at 96 to the lower end of a center pin 98 to which the upper and lower pulleys 72 and 74 are mounted. The cable length 94 then extends to the lower pulley 74 of rear set, 38 or 40 and from these the second cable portion 101 extends to the lower pulley 74 of the related front pulley set 34 or 36. Then the third cable length 102 extends from the lower forward pulley 74 of the pulley set 34 or 36 rearwardly to engage the upper pulley 72 of the related rear pulley set 38 or 40, and then extends from that pulley 72 forwardly as the fourth cable length 104. The cable length 104 extends in a curve around the upper pulley 72 of its related forward pulley set 34 or 36 to then lead into the center or draw cable section 42.

In order to appreciate some of the benefits of the present invention, it is believed it would be helpful to analyze some of its operational features and how the components interact and how the forces are transmitted throughout the system. Reference will be particularly to FIGS. 2 through 4, and also to FIG. 12.

First, consideration will be given to the cable 33. The tension force exerted on the cable 33 is derived from the tension members 24 and 26. In the initial position (rest position) of FIG. 2, the tension members 24 and 26 are already under moderate tension. In this analysis, we shall for the present ignore the frictional forces that might result from the interaction of the cable 33 and the pulley sets 34 through 40. Thus, the tension on the cable 33 can be considered as uniform along the length of the cable 33. Between each front and rear pair of pulley sets 34–38 and 36–40, there are four strands of cable (94, 100, 102 and 104). Thus, the pulling force between each pulley set pair (34–38 and 36–40) is very close to four times the tension force on the cable 33. For ease of description, each of the four cable portions 94, 100, 102 and 104 will simply be called a "pulley cable group" and be given the collective numerical designation of 106.

In addition, there is the tension force of the draw portion 42 of the cable 33. Since the cable draw portion 42 has only a single cable line portion extending to each of the front pulley sets 34 and 36, and since the tension force on the entire length of the cable 33 is assumed to be uniform, the force exerted by each of the right and left single cable portion of the cable draw portion 42 will be very close to one/fourth of that exerted by the four cable lengths extending between each pulley set pair 34–38 and 36–40 (i.e. the two pulley cable groups 106).

However, in addition to simply considering the force on the cable lengths themselves, the moment arm about which the force is exerted must be considered. To analysis this, reference is made to FIG. 12. This is a rather simplified drawing of the right frame section 16 and the right swing arm 20. For ease of illustration, the swing arm 20 itself has not been shown, but only the two end connecting members of the arm 20 are shown. Namely, the front pulley set 34 and the rear connecting point 88, and also the pivot connection 106. In addition, the tension member 24 has not been shown. Rather, the connecting locations 90 (to the rear end of the frame section 16) and 88 (the connection to the lower end of the arm portion 82 are shown).

To appreciate the significance of the following explanation, it should be understood that the launcher 10 is, in FIGS. 2 through 4, drawn exactly to scale to represent an optimized configuration of the launcher 10 that was actually constructed by the applicant. The positions of the operating components have been selected to achieve the desires interaction of these components, and this will be described more fully later herein.

Figure 13:
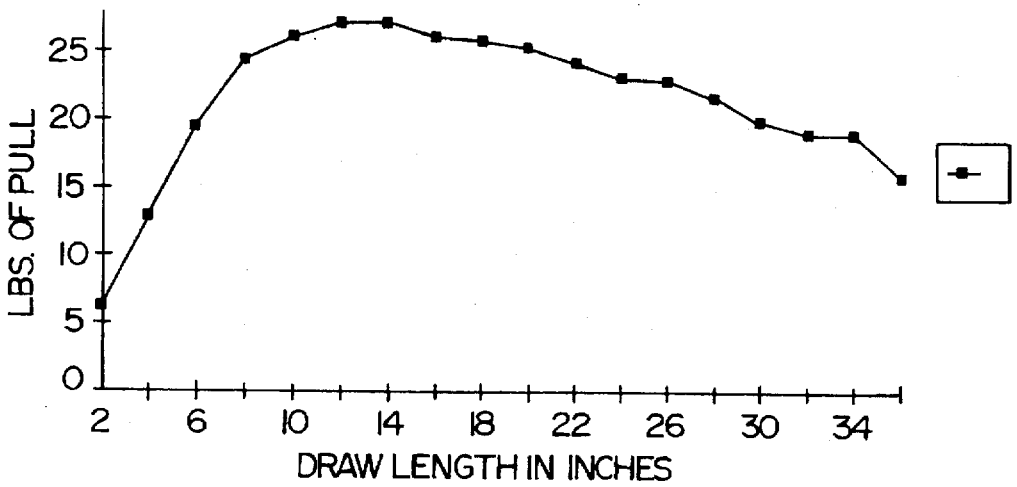
FIG. 13 is a graph plotting the draw position of the drawstring (i.e. cable) against the forward force exerted by the cable.

When the cable 33 is drawn all the way from the position of FIG. 2 to FIG. 4, the pulley set 34 moves through about 154° of travel. In FIG. 13, the travel locations are shown at 22°, 45°, 87°, 122°, and 154°. The corresponding travel locations in the same angular locations are shown for the tension member connecting point 88.

The tension force exerted by the cable group 106 on the front pulley set 34 is considered to be aligned with the center of the rear pulley set 38 (At this point, a minor clarification should be made. Since the cable portions 94 connects to the center of the pulley set 34, and since there are two cable portions 100 and 104 extending between the outside portions of the front and rear pulley sets 34 and 38, while there is only one cable portion 102 pulling between the inside portions of the cable sets 34 and 38, the total combined force exerted by the cable portions 94, 100, 102 and 104 does not act precisely through the center of the forward cable portion 34. However, for purposes of the present analysis, that discrepancy is rather minor, so it will be ignored).

Figure 12:
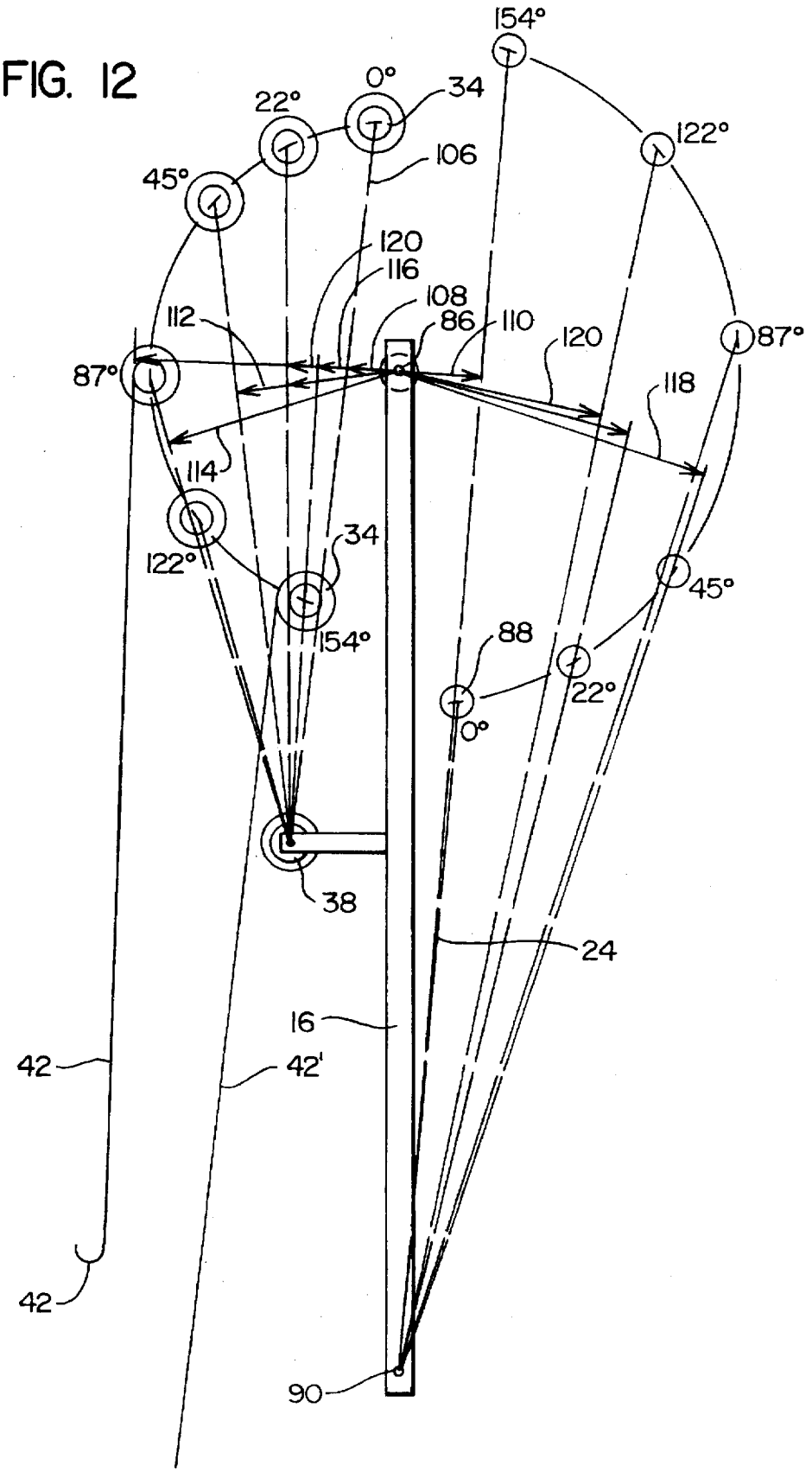
FIG. 12 is a schematic drawing showing various relationships of linear forces and moments at different operating positions.

To return to our analysis, reference is now made to FIG. 2 and also to FIG. 12. Initially, the cable draw portion 42 extends transversely, and when the cable portion 42 is initially moved from its straight line position of FIG. 2, the initial resisting force against the backward pull starts at zero and then increases rather rapidly.

Further, it can be seen with reference to FIG. 12 that along a line of force drawn from the center of the rear pulley set 38 to the center of the forward pulley set 34 is only a very short distance (indicated at 108) from the pivot location 38 of the forward swing arm portion 80. Therefore, the force exerted by the cable portion group 106 to rotate the front pulley set 34 is rather small. Also, the force moment exerted on the rear arm section 82 is very small, this being due to the fact that the moment arm 110 about which the tension member 24 is exerting its force on the rear arm section 22 is rather short.

However, let us now observe what happens when the front pulley set 34 moves from the zero to the location to the 45° location as shown in FIG. 12. During this increment of travel, the moment arm has increased from the value indicated by the arrow line at 108 to the value of the line represented at 112, with an increase of more than three times. At the same time, the amount of decrease in distance from the pulley set 34 at the zero degree location to the connecting location 38 has decreased only a small amount when the pulley 34 moves to the 45° location. Calculations indicate that at the 45° location, the cable group 106 would have shortened only thirteen percent of the total amount that this cable group 106 will shorten in moving all the way from the zero degree location of the pulley set 34 all the way to the 154° location. What this indicates is that for a relatively small portion of the travel of the cable draw portion 42, the torque exerted on the forward cable set 34 by the cable group 106 increases substantially. Then when the cable set 34 moves between the 87° and 120° location, the torque arm at 114 is at the maximum range. When the forward cable set 34 is within a short distance of its 154° location, the torque arm decreases substantially to the value indicated at the line 116.

Now attention is turned to the torque exerted by the tension member 24 as its connecting location 88 moves from the zero degree position to the 154° position. It can be seen that a similar pattern of the increase in the length of the moment arm during the middle portion of travel and the decrease in the length of the moment arm as the connecting point 88 completes its full 154° path of travel is repeated. However, the length of the moment arm at 118 becomes a maximum between the 45° and 87° location of travel.

Now consideration is given to the moment developed by the tension on the cable portion 42 that acts upon the front pulley set 34. In FIG. 12, the cable portion 42 is shown at 42' in the position where the pulley set 34 is at its 154° location. It can be seen that the moment arm 120 of the cable section 42 at 42', is slightly greater than the moment arm exerted from the rear pulley set 38.

Let us now proceed further with this analysis. The force which resists the pull back of the cable drawn portion 42 and which consequently is the same force which moves the cable portion 42 forward is derived from the two tension members 24 and 26. These two tension members 24 and 26 are pretensioned so that they exert a moderate pull on the connecting location 88 when in the rest position. Then as the swing arm 20 is rotated from the zero degree position to the 154° position, the tension member 24 becomes stretched, thus increasing its tension force. The torque created by the tension member 24 is balanced by the torque developed by the cable section group 106 acting on the front pulley set 34, and also by the torque developed by the person pulling on the drawstring 42.

As indicated earlier, since the tension force on the entire cable 33 at any one time can for practical purposes of analysis be considered as the same throughout the length of the cable 33, and since the cable group 106 comprises four cable portions to the one cable length 42 acting on the pulley set 34, the total force exerted by the cable group 106 along its length would be approximately four times that of the single cable portion 42 acting on the pulley set 34. Also, the moment exerted by the draw cable portion 42 also will vary depending upon the position of the forward pulley set 34.

Further analysis will make it apparent that the resisting force exerted on the cable draw portion 42 can be "fine tuned" by selecting the location of the forward pulley set 34 relative to the connecting location 88 of the swing arm 20, and also the positioning of the connecting location 90 of the tension member 24 and also the positioning of the rear cable set 38. At this point, a couple of observations can be made. With reference again to FIG. 12, let us examine the situation when the swing arm 20 is at the 45° position. At that location, the torque arm 118 of the tension member 24 is near to the maximum length. However, the torque arm 112 of the cable group 106 is only about two/thirds of maximum. Then when the connecting location 88 is at its 122° position, the torque arm at 120 has decreased to about 70% of maximum, while the torque arm 114 of the forward pulley set 34 at the 122° location is near maximum. At the same time, however, the tension force on the tension member 24 has increased significantly because of the stretching of the tension member 24 occurring between the 45° location and 122° location. Another observation is that by optimizing the locations of the components, the torque arms could be adjusted to modify the tension force on the cable draw portion 42 when it is very close to its end limit of travel to the pulley drawn position. This could be accomplished, for example by diminishing the length of the torque arm exerted by the tension member 24 when the connecting location 88 is at its very end limit of travel which is now at the 154° location. This would decrease the mechanical advantage (torque arm) of the tension member 24 and thus reduce the tension on the cord draw portion 42.

Further, an adjustment could be made in the positioning of the rear pulley set 38 to change the moment arm of the cord portion group 106 when the forward pulley portion 34 is near its very end limit of travel at its 154° position. For example, by moving the rear pulley set 38 to the right and also possibly forward to some extent, the moment arm of the cord portion group 106 could be increased to provide a torque matching that of the tension member 24 while reducing the tension on the cable portion 42. This could be done, if it is desired to lower the tension on the cable of pull portion 42 when it reaches very close to its end limit of travel in the fully drawn position.

It is to be understood that the analyses given above are by no means a complete analysis of all the dynamics of the system. Rather, it is done to point out some of the relationships and how the various components can be fine tuned by position adjustments, length adjustments, and relative locations to achieve the desired performance characteristic.

Reference is now made to FIG. 13, which is a graph where the force exerted at the middle of the center draw cable portion 42 is plotted against the draw length, given in inches. As indicated above, FIGS. 2–4 are drawn exactly to scale and the position of the components have been "fine tuned" to arrive at this particular force pattern. It can be seen that for the first eight inches of draw, the resisting force increases very sharply, and at eight inches of draw which is a little over twenty four pounds. At the twelve to fourteen inch draw length, the pulling force has become a maximum of twenty seven pounds. The resisting force continues to be at twenty pounds or above all the way through the thirty inch draw location, and is still at nineteen pounds at the thirty four inch draw location. Then in the last two inches of draw, there is a rather moderate, yet sharp, reduction in the pull force.

The values given in the graph of FIG. 13 are actual values which were obtained from the prototype of the present invention actually constructed to scale in accordance with the drawings of FIGS. 2 to 4.

It will be noted that the center points 130 of each of the forward pulley sets 34 and 36 are almost diametrically opposed (relative the pivot locations 88) to the center points of the connecting locations 88 for the tension members 24 and 26. In the precise configuration shown herein, the angle made by a line drawn from the center point 130 to the pivot location 184 and thence to the connecting point 88 is, as shown at 132, about 170°. Thus the pivot location 88 is slightly inside a line between the locations 130 and 88. The distance from the pivot location 84 to the connecting location 88 is about one and one half times greater than the distance from the pivot location 84 to the front pulley set center location 130, and it is estimated within a broader range, that the distance from points 88 to 84 should at least be equal to, or possibly up to as high as two times as great as, the distance from the points 130 to 184.

Also, it will be noted that a line drawn from the pivot location 130 to the center location 134 of the rear pulley sets 38 and 40 is slightly inside of the pivot location 84. Further it will be noted that the center locations 134 of each of the rear pulley locations 38 and 40 are positioned closer to the longitudinal center line than a related line drawn between the two center locations 84 to 90.

These particular positions and relative values have been arrived at partly by analysis and partly empirically to arrive at an optimized version shown in scale in FIGS. 2 through 4.

Reference is now made to FIGS. 6 through 9. This simply shows a modified arrangement of the present invention, components of the second embodiment which are similar to the first embodiment will be given like numerical designations with an "a" suffix distinguishing those of the second embodiment. It can be seen that all of the major components are rather similar, except that instead of anchoring the cable portion 94*a* to the forward pulley set it is attached to a rod member 140 which is in turn resiliently positioned by a compression spring 132 and operatively connected to the frame members 16*a* and 18*a*. Also, instead of having four cord length group 106, there are only three cord lengths in the group 106*a*.

Figure 10:
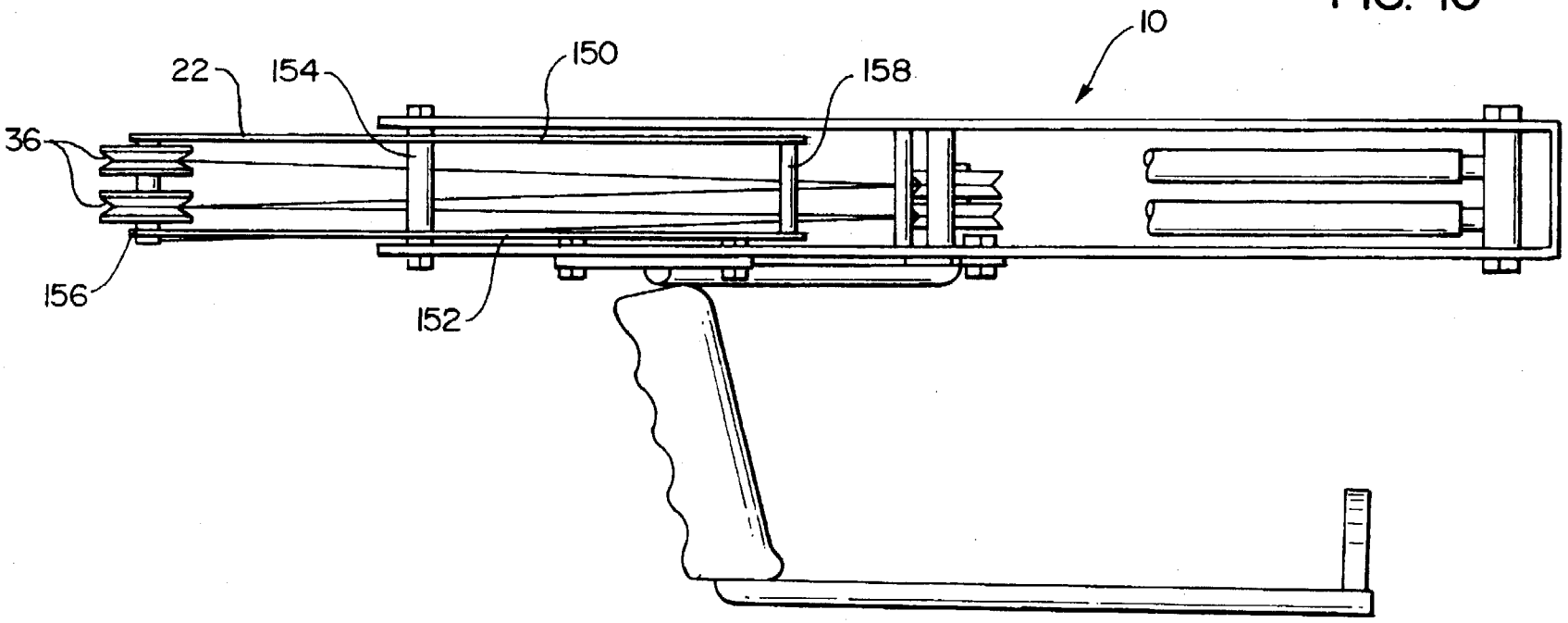
FIG. 10 is a side elevational view of a modification of the swing arm of the first embodiment of the present invention.

FIG. 10 shows a modified form of the right and left swing arms 20 and 22. Instead of each of these arms 20 and 22 being formed as single bar members, these arms 22 and 20 are formed as upper and lower arm sections 150. These are joined by a middle pivot pin 154, a forward pin 156 which carries the forward pulley sets 34 and 36, and a rear pin 158 which provides an attachment to the tension members 24 and 26.

Figure 11A:
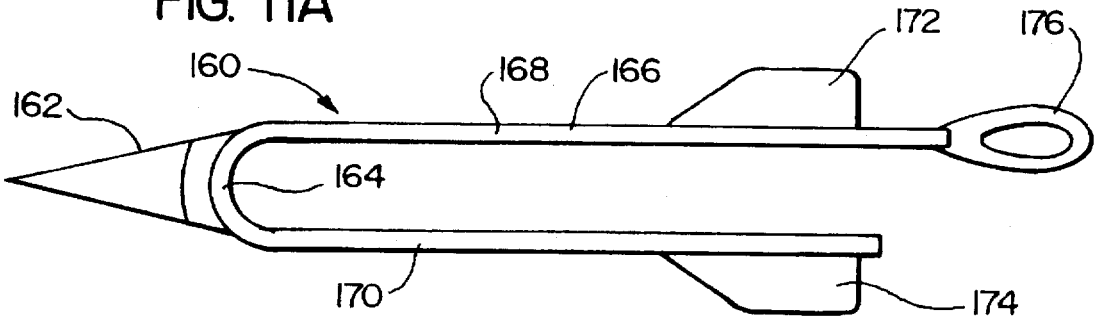
FIG. 11A is a side elevational view of a dart or dart-like projectile adapted for use in the present invention.

FIG. 11A shows a dart or projectile 160 which can be used effectively in the present invention. This projectile 160 comprises a front point member 162 attached to a front connecting end portion 164 of a U shaped body member 166 having first and second longitudinally extending legs 168 and 170, which define with the front portion at rearwardly facing recess 171 to receive the middle cable portion 42. A pair of fins 172 and 174 are mounted to the rear ends of the legs 168 and 170 to provide aerodynamic stability. A loop member 176 is attached to the rear of the leg 168.

Figure 11B:
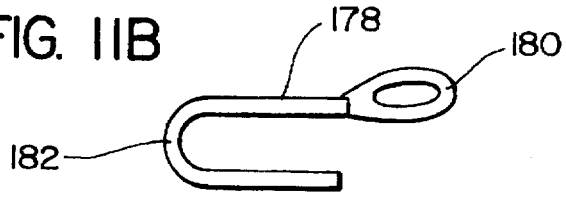
FIG. 11B is a side view of a retracting device to be used in connection with the projectile of FIG. 11A.

This projectile 160 is utilized by inserting the draw cable portion 42 in the recess between the two legs 168 and 170 so as to bear against the forward body portion 164. A conventional retracting device 178, shown in FIG. 11B, can be used to engage the loop 176 by a loop portion 180 of the device 178. This member 178 also has a finger engaging portion 182. There is a release mechanism by which the loop 180 can be opened to release it from engagement with the loop 176, thus permitting the projectile 160 to be propelled against the target.

Figure 14A:
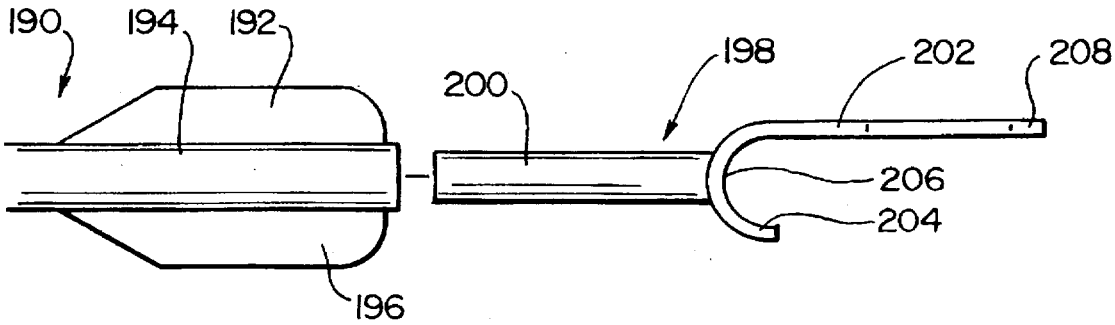
FIG. 14A is a side view of the rear attaching end of an arrow which can be used with the present invention effectively.
Figure 14B:
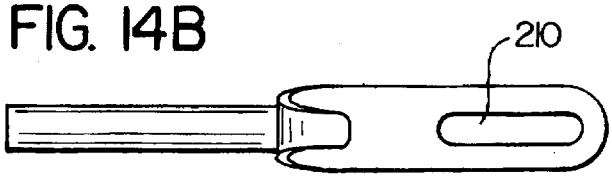
FIG. 14B is a top view of the attaching portion of the arrow of FIG. 11B.

FIGS. 14A and B show an arrow 190 particularly adapted for use in the present invention. For convenience of illustration, only the rear end 192 of the shaft 194 of the arrow is shown, along with the fins 196. There is a rear end attachment 198 comprising a cylindrical member 200 that is fixedly connected within the rear end opening in the shaft 192. The cylindrical member 200 is fixedly connected at its rear end to a connecting member 202 having a semi-circular front portion 204 defining a recess 206 into which the drawstring or cable 42 fits. The connecting portion has a straight bar portion 208 having an elongate longitudinally aligned opening 210 which can be engaged by a suitable retracting member, such as shown at 178 in FIG. 11B. It can be seen in observing FIG. 4 that in the full draw position, the right and left portions of the center draw portion 42 of the cable 33 extend rearwardly at a very small diverging angle. Thus, the attaching device 198 provides a very convenient means of engaging the center portion of the center drawstring portion 42. This same advantage is provided by the dart-like members shown in FIG. 11A.

Figure 15:
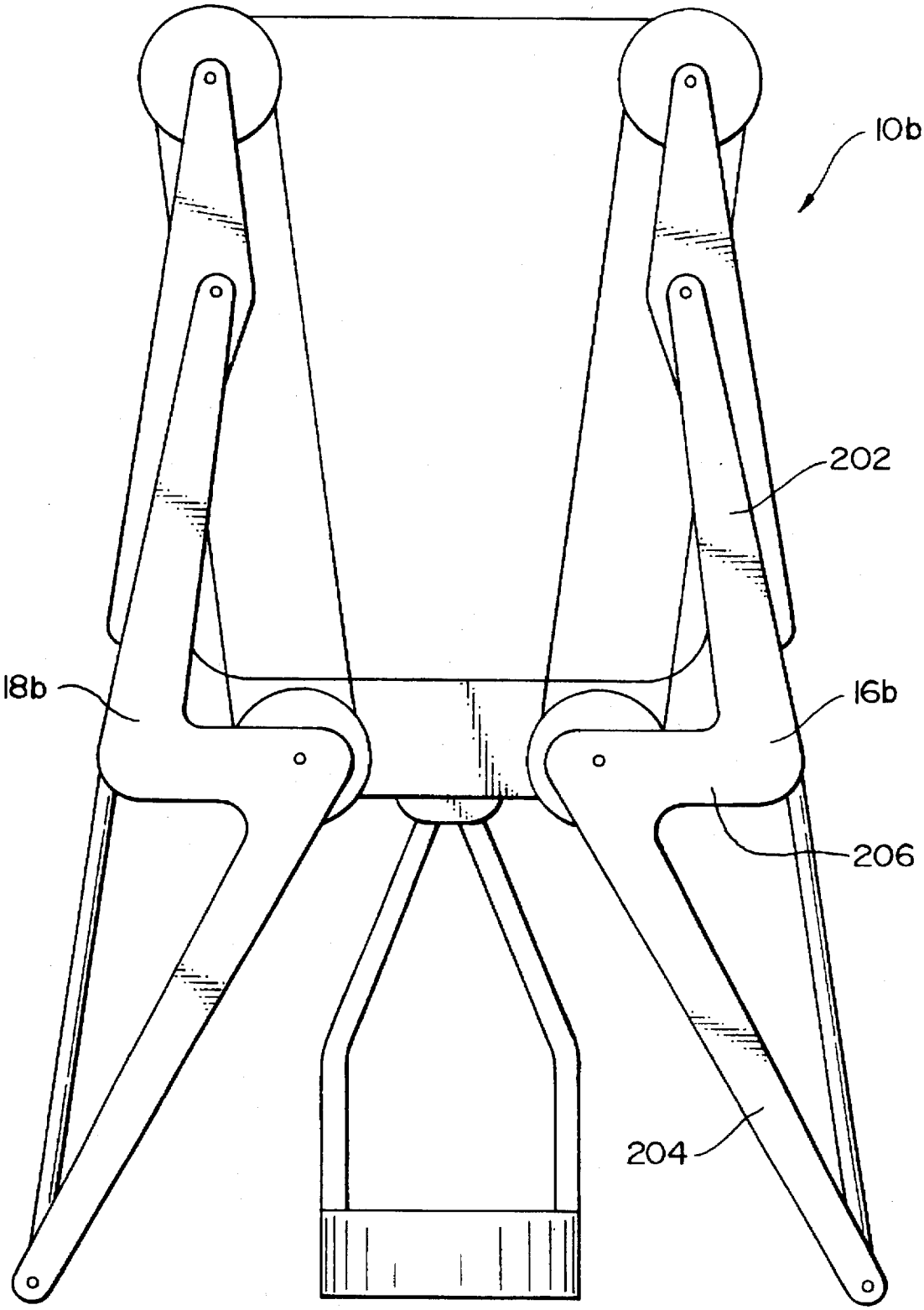
FIG. 15 is a top plan view of a third embodiment of the launcher of the present invention showing a modified configuration of the main frame.

FIG. 15 shows a third embodiment of the launcher, designated 10*b*. This launcher is substantially the same as the launcher 10 of the first embodiment, except that the right and left frame sections 16*b* and 18*b*, are not configured as straight bars, but have what might be termed a shallow "Z" shape. Thus, each side frame section 16*b* and 18*b* has a "Z" shape comprising a forward section 202, a rear section 204 and an interconnecting lateral section 206. The forward section 202 extends rearwardly at a moderate outward slant, and connects at its rear end to the central section 206 which extends laterally inwardly, which in turn connects to the forward end of the rear section 204 which extends rearwardly at an outward slant.

In terms of function, the third embodiment 10*b* operates in substantially the same manner as the first embodiment shown in FIGS. 1 through 5.

It is obvious that various modification can be made in the present invention without departing from the basic teachings thereof.

What is claimed:

1. A projectile launching apparatus comprising;

a. a base frame having a longitudinal center axis, a transverse axis, a front end, and a rear end, said base frame having a support portion, and right and left frame sections, each of said frame sections, each having a front pivot location, a cable positioning location, and a rear tension load bearing location;

b. right and left swing arms, each having a first front end portion at which there are right and left front pulley means, respectively, at front pulley locations, a second end portion at which there is a front tension load bearing location, and an intermediate portion having a pivot mounting location, said right and left swing arms being pivotally mounted at their respective pivot locations to the right and left frame sections, respectively, at said front pivot locations of the frame sections;

c. said right and left swing arms being mounted and arranged for rotation between a first rest position where the right and left front pulley means at the front end portion are at a more forward location, and a second launching position where the right and left front pulley means are at a more rear location;

d. right and left tension members, each being connected at a rear end thereof to a respective rear tension load bearing location of the right and left frame sections, and connected at a front end thereof to the second end portion of the right and left swing arms, respectively, at the respective front tension load bearing locations;

e. a cable means having a middle cable portion extending between said front pulley means of the swing arms and being in operative engagement with said front pulley means, and right and left cable portions extending operatively from said right and left front pulley means to connect operatively to said right and left frame sections, respectively, at the cable positioning locations of the right and left frame members;

f. said apparatus being arranged in a manner that when the middle cable portion is pulled rearwardly, said right and left front pulley means are pulled rearwardly, to cause the second end portions of the right and left swing arms to move forwardly and thus extend the right and left tension members.

2. The launching apparatus as recited in claim 1, further comprising right and left rear pulley means mounted, respectively, at the cable positioning locations of said right and left frame sections, said right and left cable portions each having first cable sections extending from the front pulley means of the right and left arm members to operatively engage the right and left rear pulley means and second cable sections of the right and left cable portions extend back to the front end portions of the right and left swing arms to have operative connections at locations of the front end portions of the right and left swing arms.

3. The launching apparatus as recited in claim 2, wherein each of the front pulley means of the right and left swing arms comprises at least first and second front pulley members, and the second cable sections of the right and left cable portions that extend from the rear pulley means to the front pulley means engage said second pulley of its related front pulley means and extends rearwardly therefrom to form third rearwardly extending cable sections of said right and left cable portions, said middle cable portion engaging the first pulley members of the right and left front pulley means.

4. The apparatus as recited in claim 3, wherein each of said third rearwardly extending cable section of the right and left cable portions connect to, respectively, said right and left frame sections.

5. The apparatus as recited in claim 3, wherein each of said rear pulley means comprises first and second rear pulley members, said first and second cable sections of each of said right and left cable portions engaging, respectively, first rear pulley members of the right and left cable portions, the third cable section of each of said right and left cable portions extending around its related second rear pulley member of the rear pulley means to extend forwardly as a fourth pulley section to connect to the front end portions of the right and left swing arms.

6. The apparatus as recited in claim 1, wherein said front pulley means of said right and left swing arms has a cable connecting location, and the cable connecting location is, relative to the pivot mounting location of the right and left arms substantially diametrically opposite to the front tension load bearing locations of the right and left arms.

7. The apparatus as recited in claim 6, wherein said right and left swing arms are arranged in said apparatus relative to said cable means so that the front end portions of the swing arms in moving from the first rest position rotate toward the longitudinal center axis to an intermediate swing arm position, and continue rotation toward said second launching location so as to move away from said longitudinal center axis.

8. The apparatus as recited in claim 7, wherein the second end portions of the right and left swing arms move from the rest position in a direction away from said longitudinal axis toward an intermediate position, and move from the intermediate portion toward the launching position in a manner to move toward the longitudinal center axis.

9. The apparatus as recited in claim 8, wherein a distance from the pivot mounting location of the right and left swing arms to the tension load bearing location is between about one to two times as great as a distance from the pivot mounting location to the front pulley location.

10. The apparatus as recited in claim 6, wherein in the rest position, the front tension load bearing locations on the right and left swing arms are positioned further away from the longitudinal axis than a line drawn between the front pivot location and the rear tension load bearing location of the right and left frame sections.

11. The apparatus as recited in claim 10, wherein in the rest position, a line drawn between the front pivot location of the right and left swing arms to the right and left cable positioning locations of the frame extends between the front pivot location of the right and left frames, respectively, and the longitudinal center axis.

12. The apparatus as recited in claim 11, wherein the rear tension load bearing locations of the right and left frame sections, respectively, are positioned between the longitudinal axis and a line drawn from the front pivot location to the rear tension load bearing location of the right and left frame sections, respectively.

13. A launching apparatus and projectile combination, comprising:

a. a projectile launching apparatus comprising:

i. a base frame having a longitudinal center axis, a transverse axis, a front end, and a rear end, said base frame having a support portion, and right and left frame sections, each of said frame sections each having a front pivot location, a cable positioning location, and a rear tension load bearing location;

ii. right and left swing arms, each having a first front end portion at which there are right and left pulley means, respectively, at front pulley locations, a second end portion at which there is a front tension load bearing location, and an intermediate portion having a pivot mounting location, said right and left swing arms being pivotally mounted at their respective pivot locations to the right and left frame sections, respectively, at said front pivot locations of the frame sections;

iii. said right and left swing arms being mounted and arranged for rotation between a first rest position where the right and left front pulley means at the front end portion is at a more forward location, and a second launching location where the right and left front pulley means is at a more rear location;

iv. right and left tension members, each being connected at a rear end thereof to a respective rear tension load bearing location of the right and left frame sections, and connected at a front end thereof to the second end portion of the right and left swing arms, respectively, at the respective front tension load bearing location;

v. a cable means having a middle cable portion extending between said front pulley means of the swing arms and being in operative engagement with said front pulley means, and right and left cable portions extending operatively from said right and left front pulley means to connect operatively to said right and left frame sections, respectively, at the cable positioning locations of the right and left frame members;

vi. said apparatus being arranged in a manner that when the middle cable portion is pulled rearwardly, said right and left front pulley means are pulled rearwardly, to cause the second end portions of the right and left swing arms to move forwardly and thus extend the right and left tension members;

b. a projectile having a cable engaging portion which defines a rearwardly facing and rearwardly open recess to receive said middle cable portion, and a projectile engaging portion positioned rearwardly of said recess, said projectile engaging portion being adapted to be engaged to pull said projectile in a rearward direction to pull the middle cable portion rearwardly.

14. The apparatus as recited in claim 13, wherein said projectile is a dart, having a front point member and rearwardly extending legs defining said recess.

15. The combination as recited in claim 13, wherein said projectile is an arrow with an arrow shaft, and said recess forming portion is connected to a rear end portion of said shaft.

16. The combination as recited in claim 13, wherein said engaging portion comprises a loop means extending in at least a partial loop to engage a releasable pull member.

* * * * *